US006357380B2

(12) United States Patent
Holcomb et al.

(10) Patent No.: US 6,357,380 B2
(45) Date of Patent: Mar. 19, 2002

(54) LIGHTWEIGHT RESCUE BOAT DAVIT

(75) Inventors: Richard S. Holcomb, Bethesda, MD (US); Peter Pritchet, Southhampton; Robert A. Cope, Portsmouth, both of (GB)

(73) Assignee: Swath Europe Limited, Rockford, IL (US)

( * ) Notice: Subject to any disclaimer, the term of this patent is extended or adjusted under 35 U.S.C. 154(b) by 0 days.

(21) Appl. No.: 09/781,468

(22) Filed: Feb. 12, 2001

Related U.S. Application Data

(60) Provisional application No. 60/182,378, filed on Feb. 14, 2000.

(51) Int. Cl.[7] ..... B63B 23/18
(52) U.S. Cl. ..... 114/373; 114/368
(58) Field of Search ..... 114/365, 366, 114/368, 369, 373; 182/2.3

(56) References Cited

U.S. PATENT DOCUMENTS 1,398,702 A 11/1921 Maggi
2,650,377 A 9/1953 Barricelli ..... 9/39
3,880,254 A * 4/1975 Fitzgerald et al. ..... 182/2
5,706,755 A 1/1998 O'Brien ..... 114/365
5,996,524 A 12/1999 Johnson ..... 114/210
6,038,994 A 3/2000 Ford et al. ..... 114/259
6,095,080 A 8/2000 Weber ..... 114/370

* cited by examiner

*Primary Examiner*—Ed Swinehart
(74) *Attorney, Agent, or Firm*—McAndrews, Held & Malloy, Ltd.

(57) ABSTRACT

A SOLAS-compliant rescue boat davit for storing, launching and retrieving a rescue boat. The rescue boat davit has an A-frame lifting arm that supports the rescue boat in a stowed position and rotates approximately 20° about the base of the A-frame to assist in hoisting and lowering the rescue boat. A sheave assembly and a davit stop fitting assembly are mounted on the apex of the A-frame lifting arm and accommodate a winch line at the A-frame apex. An electrical winch hoists and lowers the rescue boat, via the winch line, and a stop ring on the winch line operates in conjunction with the davit stop fitting to cause the winch line to rotate the A-frame lifting arm forward. A post assembly mounted to the transom of a ship provides a mount for the electrical winch and supports the A-frame lifting arm via a wire strop. A boarding platform is also mounted to the transom of the ship to permit boarding of the rescue boat in its stowed position.

18 Claims, 14 Drawing Sheets

LIGHTWEIGHT RESCUE BOAT DAVIT

CROSS REFERENCE TO RELATED APPLICATIONS

Priority is claimed of U.S. Provisional Application, U.S. Ser. No. 60/182,378, filed Feb. 14, 2000.

FIELD OF THE INVENTION

The present invention relates in general to davits that are used to store, launch and retrieve skiffs or rescue boats. In particular, the present invention relates to a SOLAS-compliant, lightweight davit used on a catamaran or a ship to store, launch and retrieve a rescue boat.

BACKGROUND OF THE INVENTION

Most ships, especially passenger ships, are governed by national and international laws and regulations which are intended to ensure a safe ship, safe operations of the ship and proper registration and use of the ship within national and international waters. The rules and regulations governing international passenger ships include the International Maritime Organization's (IMO) High-Speed Code (Resolution MSC.36 (63)), the Safety of Life at Sea (SOLAS) regulations, and the Subchapter H regulations for passenger ships, as defined in United States Code of Federal Regulations, 46 CFR.

Since a rescue boat plays a critical role in the emergency evacuation of a ship, the United States Coast Guard (USCG) classifies a davit, which is used to secure, launch and retrieve the rescue boat, as a piece of lifesaving equipment. The design and testing of lifesaving equipment for Subchapter H ships are governed by specific rules and regulations. In particular, the Safety of Life at Sea regulations 13, 14, 15, 16, 20, 47 and 48 of Chapter III, Parts B and C, govern the design of life boats and rescue boats, and the International Maritime Organization's Resolution A.689(17), Parts 1 and 2, govern testing of equipment.

Accordingly, in order to be SOLAS compliant, a rescue boat davit must be designed to meet at least the following criteria:

1. The davit must not depend on any means other than gravity or stored mechanical power which is independent of the ship's power supplies to launch the rescue boat;

2. The rescue boat is to be stowed in a state of readiness for launching in not more than five minutes;

3. The rescue boat is to be launchable with the ship making headway at speeds up to 5 knots, in calm water;

4. The rescue boat is to be rapidly recoverable with a full load, including the rescue boat engine, fuel, entrained water, first aid kit and at least six persons;

5. The davit is to be capable of launching the rescue boat against a ship's trim of 10° in either direction and against a ship's heel of 20°, in either direction;

6. The davit is to be operable by a single person on the deck of the ship or a single person within the rescue boat;

7. The davit must incorporate safety devices which automatically cut off the power before the davit arms reach the stops in order to avoid overstressing the falls or davits;

8. The davit is to be designed with a factor of safety of 4.5 on the structural components of the davit and the winch and a factor of safety of 6.0 on the falls, suspension chains, links and blocks;

9. The davit must be capable of a minimum lowering speed determined in accordance with the following equation:

$$S=0.4+0.2H$$

where: S is the lowering speed in meters/sec.

H is the height of the davit head above the waterline in meters; and

10. The davit must be capable of hoisting the fully loaded rescue boat at a speed of at least 0.3 meters/second.

Davit systems for storing, launching and retrieving skiffs or rescue boats have been known for some time. Those that are SOLAS compliant, however, are typically fairly heavy and mechanically complex. There is, therefore, a need for a SOLAS-compliant davit system for a weight-sensitive aluminum ship wherein the davit system is lightweight, has a fairly simple mechanical structure, and is easy to operate.

SUMMARY OF THE INVENTION

A principal object of the present invention is to provide a rescue boat davit that meets all of the design requirements of the SOLAS, IMO and 46 CFR regulations.

Another object of the present invention is to provide a boat davit that is relatively light in weight and mechanically simple in design.

A further object of the present invention is to provide a boat davit that can launch a rescue boat between the hulls, at the stern, of a SWATH ship or catamaran with forward speed.

A still further object of the present invention is to provide a boat davit that can also permit stern-launching on conventional monohulls.

Another object of the present invention is to provide a boat davit that is "retrofittable" onto a fully built, weight sensitive aluminum ship.

The foregoing objects of the invention can be accomplished by a rescue boat davit having a tilting A-frame lifting arm, a winch assembly and an upright post assembly for mounting the winch to the ship. The A-frame lifting arm includes two elongated legs integrally joined at one end thereof to form an apex, and pivotally mounted at the other end thereof to the transom of a ship. The A-frame lifting arm is pivotally moveable between an upright rescue boat stowage position and a lowered rescue boat launching and retrieving position. The A-frame lifting arm also includes a sheave assembly mounted on the apex of the A-frame lifting arm. The winch assembly includes a cable drum and a winch line. One end of the winch line is wound about the cable drum, and the other end is releasably fastened to the rescue boat, with the winch line passing over the sheave assembly to suspend the rescue boat from the apex of the A-frame lifting arm. A boarding platform is mounted to the ship and provides access to the rescue boat when it is in a stowed position.

DETAILED DESCRIPTION OF THE INVENTION

Figure 1:
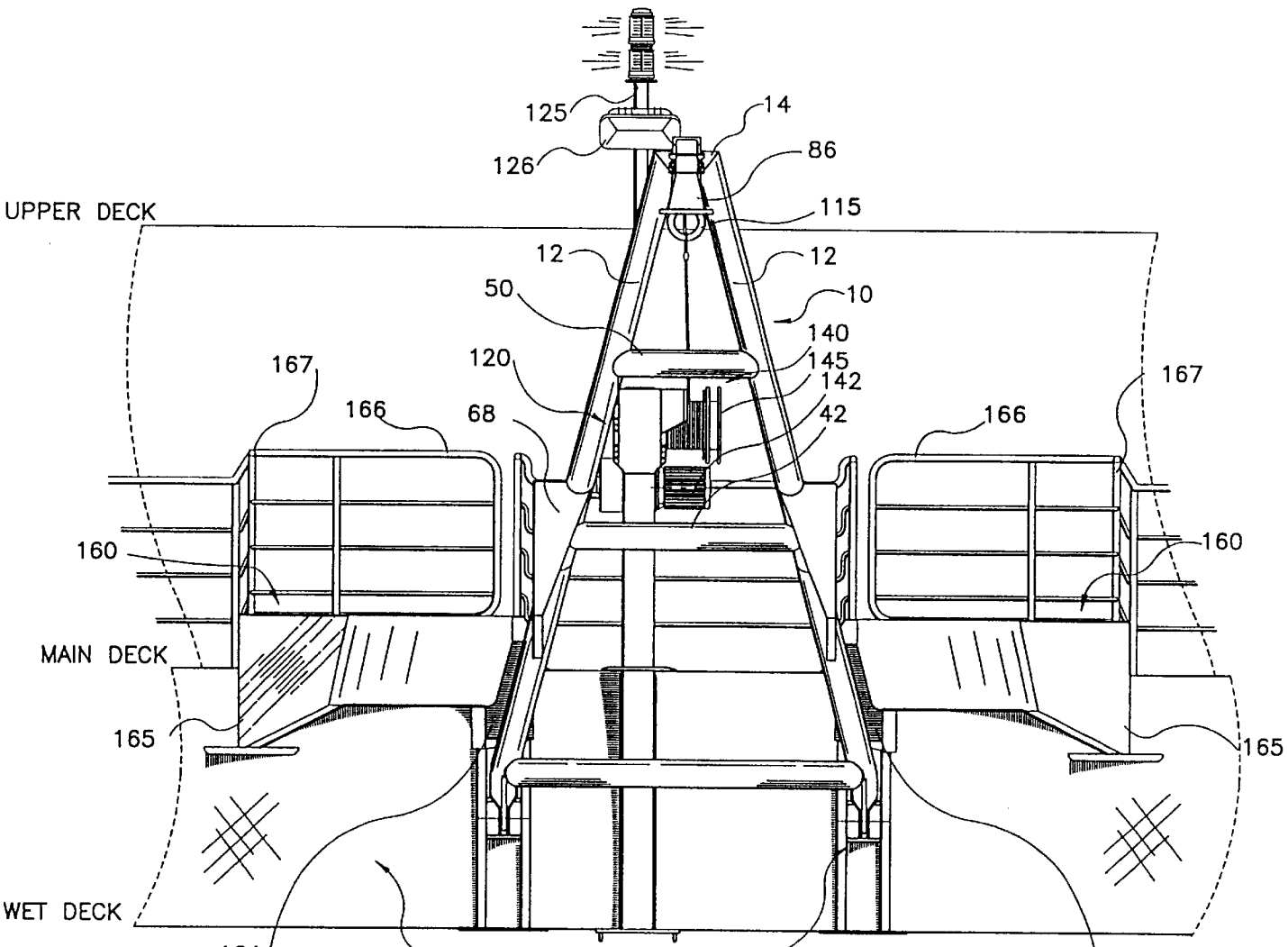
FIG. 1 is a front elevation view of the boat davit of the present invention, with the rescue boat omitted for clarity.

The boat davit of the present invention, for storing, launching and retrieving a rescue boat for a ship, is shown generally in FIGS. 1–5. The davit comprises the following three major components: an A-frame lifting arm 10 for supporting a rescue boat 8 during storage, and assisting in the launching and hoisting of the rescue boat, an electrical davit winch 140 for hoisting and lowering the rescue boat, and a post assembly 120, which provides a mount for the electrical winch. Typically, the rescue boat 8 is a rigid hull inflatable boat (RIB). In addition, a boarding platform 160 is provided to allow boarding of the rescue boat 8 when the rescue boat is in the stowed position, illustrated in FIGS. 1–3.

The A-frame lifting arm 10 is advantageously manufactured from marine-grade aluminum tubing and comprises two legs 12 joined at their outboard ends to form an apex 14. The legs have inboard base ends 16, each of which is slotted to receive a hinge lug 18 for mounting the A-frame 10 to the transom 20 of a ship. The hinge lug 18 is welded to the slotted base end 16 of each leg 12 and is provided with a through hole 22 (see FIG. 7) for receiving a through bolt 32 (see FIG. 8) utilized for mounting the A-frame to fork fittings 30 that are bolted to the ship's transom.

Figure 8:
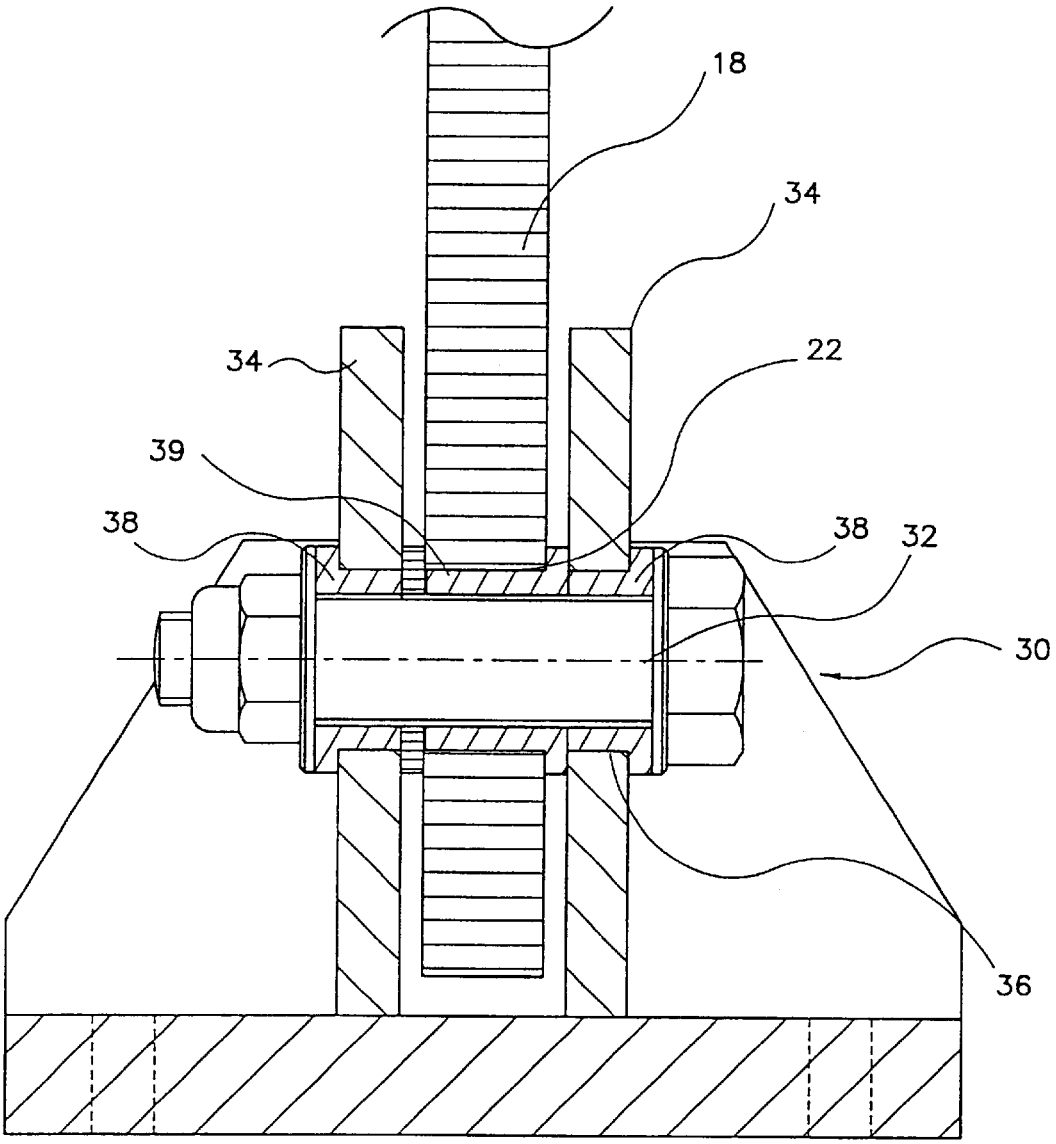
FIG. 8 is a longitudinal cross-sectional view of the A-frame fork fitting assembly.

Referring to FIG. 8, each fork fitting 30 has a pair of upright plates 34 that are spaced sufficiently apart to receive the hinge lug 18. The plates 34 are each provided with a through hole 36 which is aligned with the through hole 22 in the hinge lug 18. The through bolt 32 passes through the through holes 36 and 22 in the plates 34 and hinge lug 18, respectively, to provide pivotal mechanical attachment of the legs of the A-frame to the fork fitting 30. The mounting of the A-frame is designed to allow the A-frame to rotate approximately 20° around the base of the A-frame. Bushes 38 and 39 are provided in the through holes 36 of the plates 34 and through hole 22 of the hinge lug 18, respectively, to ensure smooth pivotal movement of the A-frame.

Figure 6:
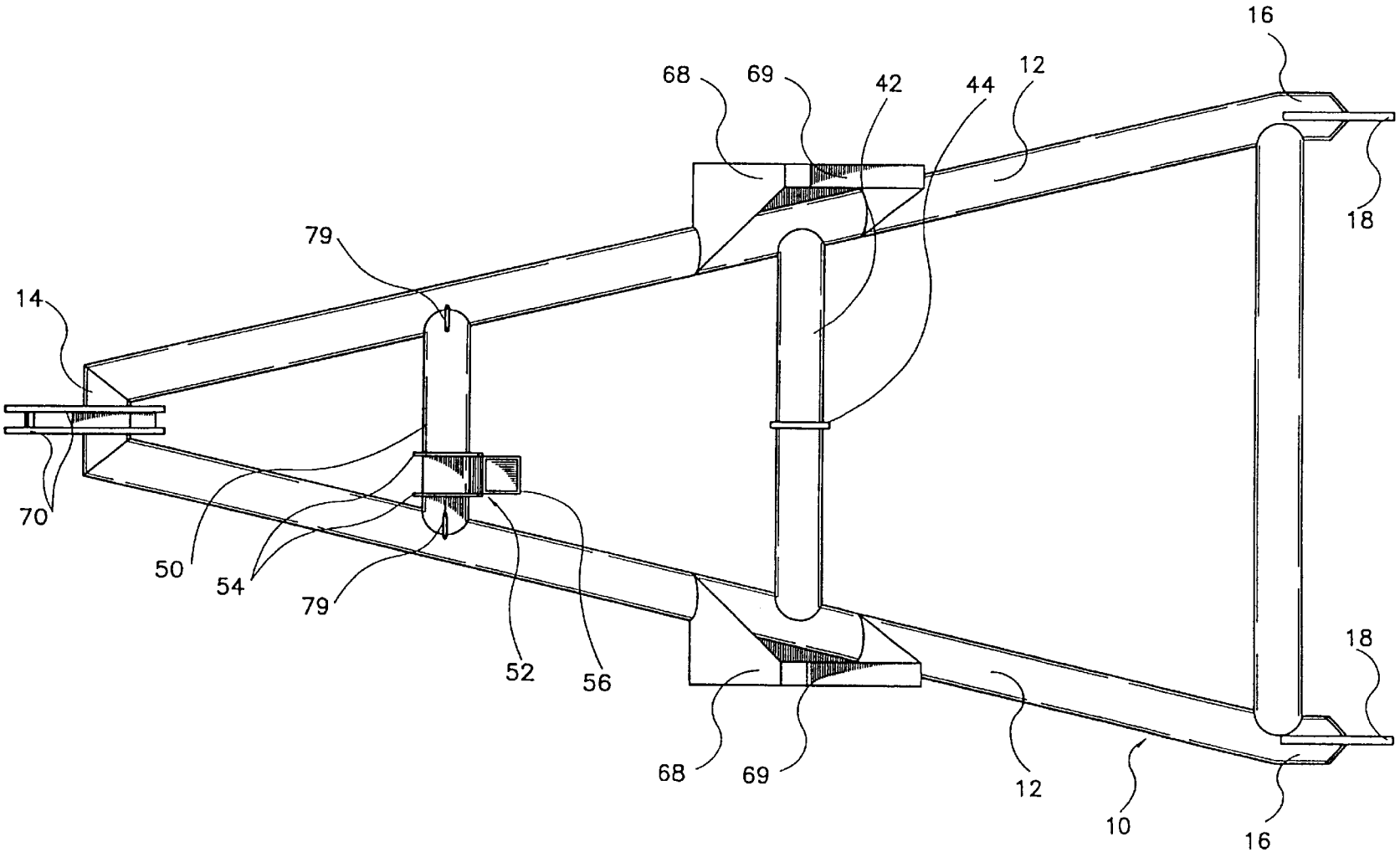
FIG. 6 is a bottom plan view of the A-frame lifting arm.
Figure 7:
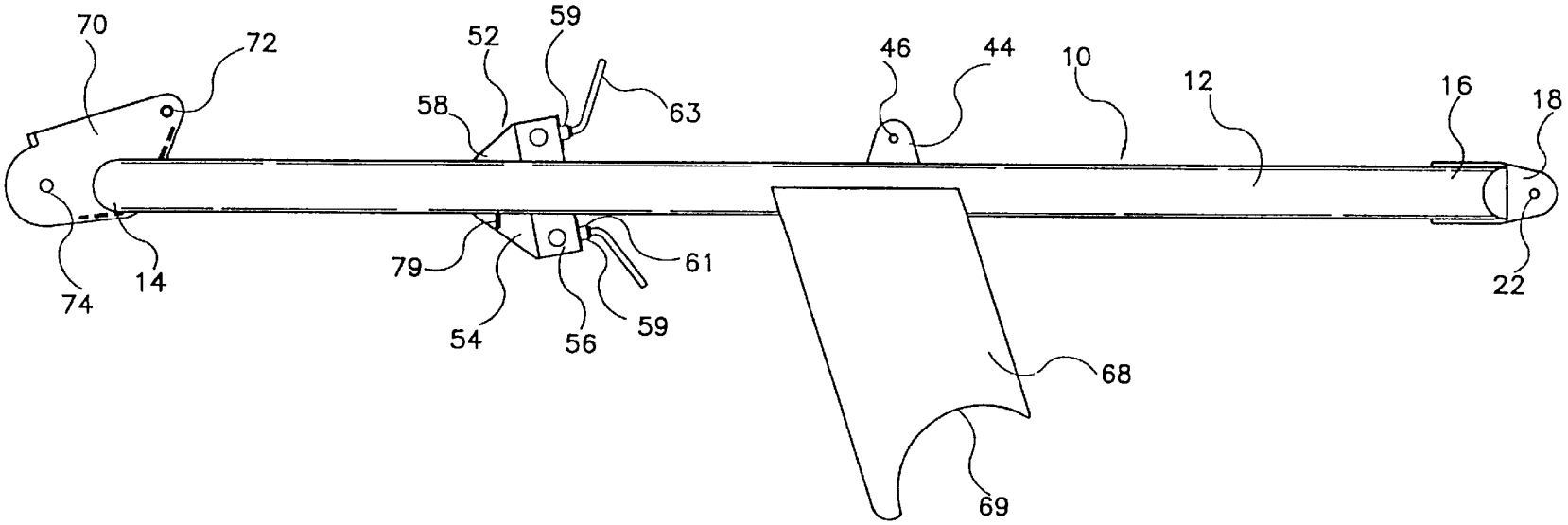
FIG. 7 is a side elevation view of the A-frame lifting arm.

As best illustrated in FIGS. 6 and 7, the A-frame also includes a cross bar 42 and a cross bar 50 each of which is secured to and extends between the legs 12. A restraining lug 44 is mounted on the cross bar 42 and has a drilled hole 46 for receiving a "D" shackle that attaches one end of a securing wire 48 (see FIGS. 3, 11*a* and 11*b*) to the restraining lug.

Figure 11A:
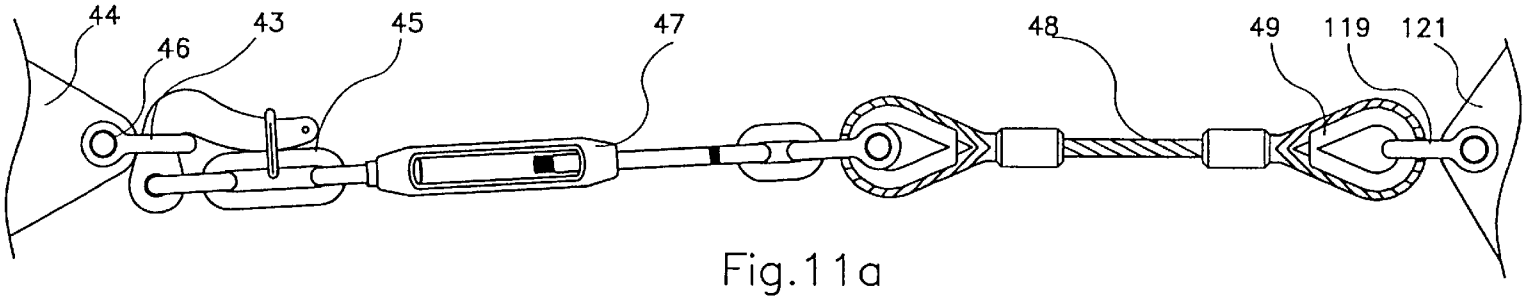
FIG. 11*a* is a top plan view of the securing wire.
Figure 11B:
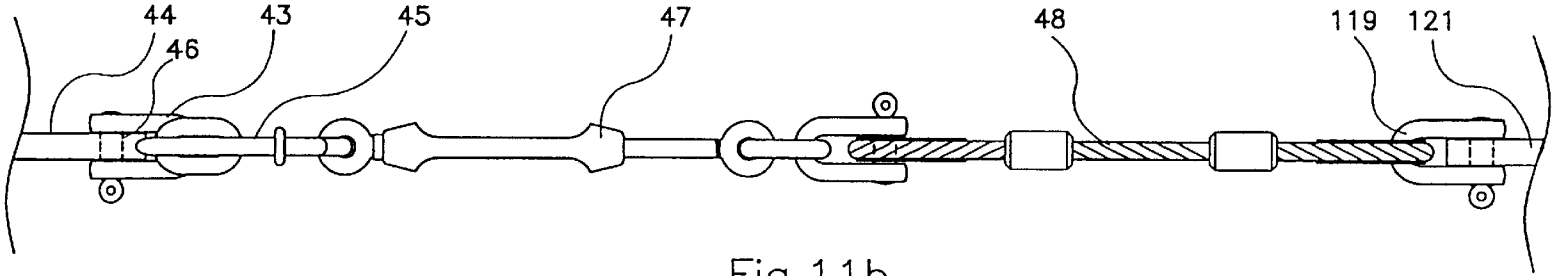
FIG. 11*b* is a side elevation view of the securing wire.

As detailed more particularly in FIGS. 11*a* and 11*b*, one end of the securing wire 48 is fitted with a releasable split pin and lanyard 45 which receives the "D" shackle 43 for attaching the securing wire to the restraining lug 44. Alternatively, another attachment mechanism, such as a pelican hook or a senhouse slip, could be fitted on the end of the securing wire to permit releasable attachment of the securing wire 48 to the restraining lug 44. The other end of the securing wire 48 is provided with an eye or thimble 49 that receives a "D" shackle 119. The "D" shackle 119 serves to fasten the securing wire to a plate 121 (see FIG. 3) mounted to the post assembly 120. The securing wire 48 is also provided with a turn buckle or bottle screw 47 to allow the length of the securing wire to be adjusted when the securing wire 48 is attached to the restraining lug. In this position, the securing wire 48 helps to maintain the A-frame in its upright stowage position, as shown in FIG. 3, and aids in taking the load of the A-frame and rescue boat off of the winch line 105 when the davit is not in use.

Figure 5:
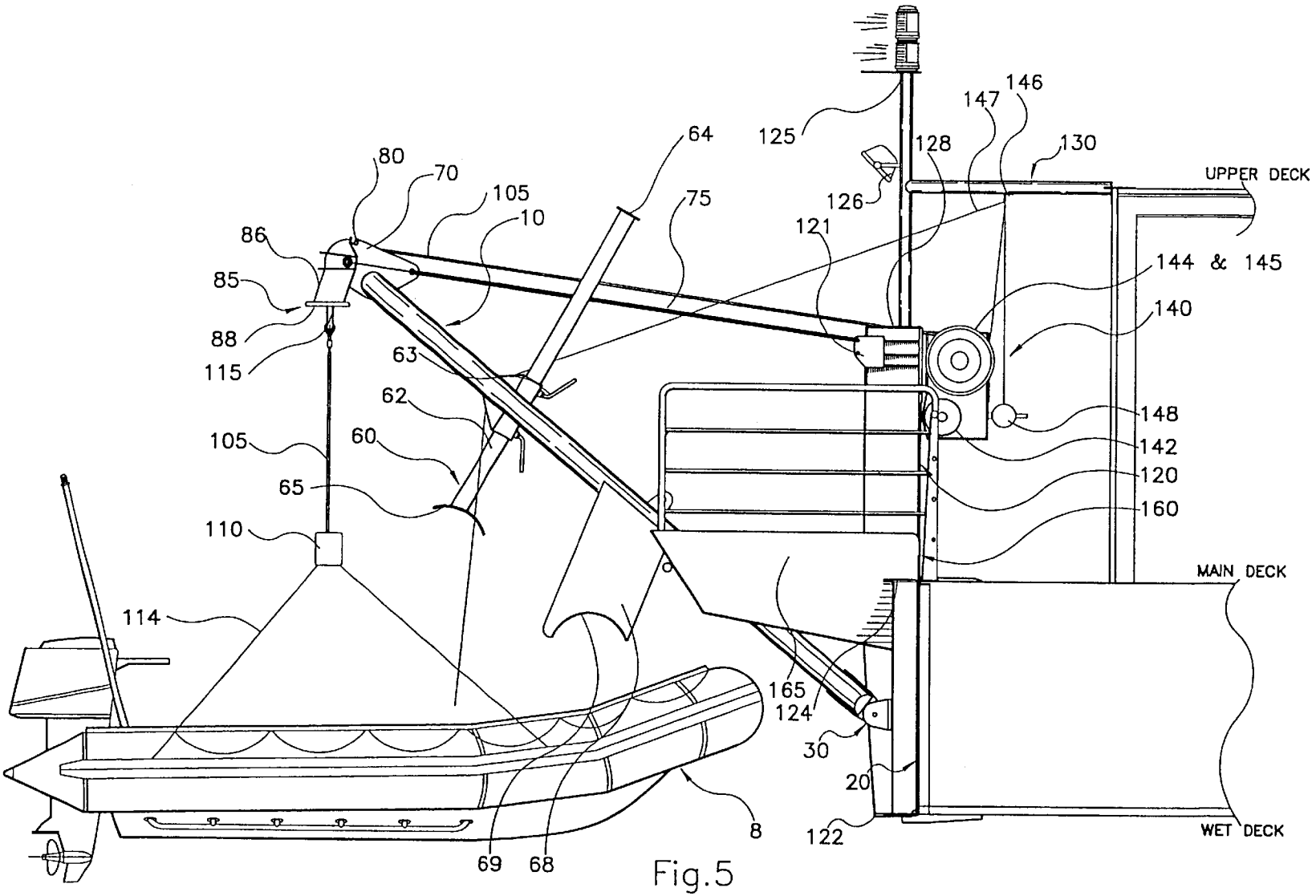
FIG. 5 is a side view of the present invention, with the rescue boat shown in deployed position.

Referring back to FIGS. 6 and 7, the cross bar 50 provides a mounting for a clamp assembly 52, which supports a manually adjustable outer crutch assembly 60 (FIG. 5). The clamp assembly comprises side plates 54 that are spaced apart and welded to a crutch-receiving tube 56. The side plates are each provided with a bore 58 which receives the cross bar 50 to permit the clamp assembly to be mounted on the cross bar. The crutch-receiving tube 56 preferably has a square-shaped cross-section that is dimensioned to slidingly receive the support leg 62 (see FIG. 5) of the outer crutch assembly. The sidewall of the crutch-receiving tube 56 opposite the side plates 54 is provided with locating holes, each of which is surrounded by a crutch clamp 59. Each crutch clamp 59 has a bore 61 which is aligned with the locating hole and receives one end of a clamp handle 63. The clamp handle 63 can be rotated so that the end of the clamp handle within the bore 61 contacts the support leg of the crutch assembly to hold the support leg in a desired position.

Figure 2:
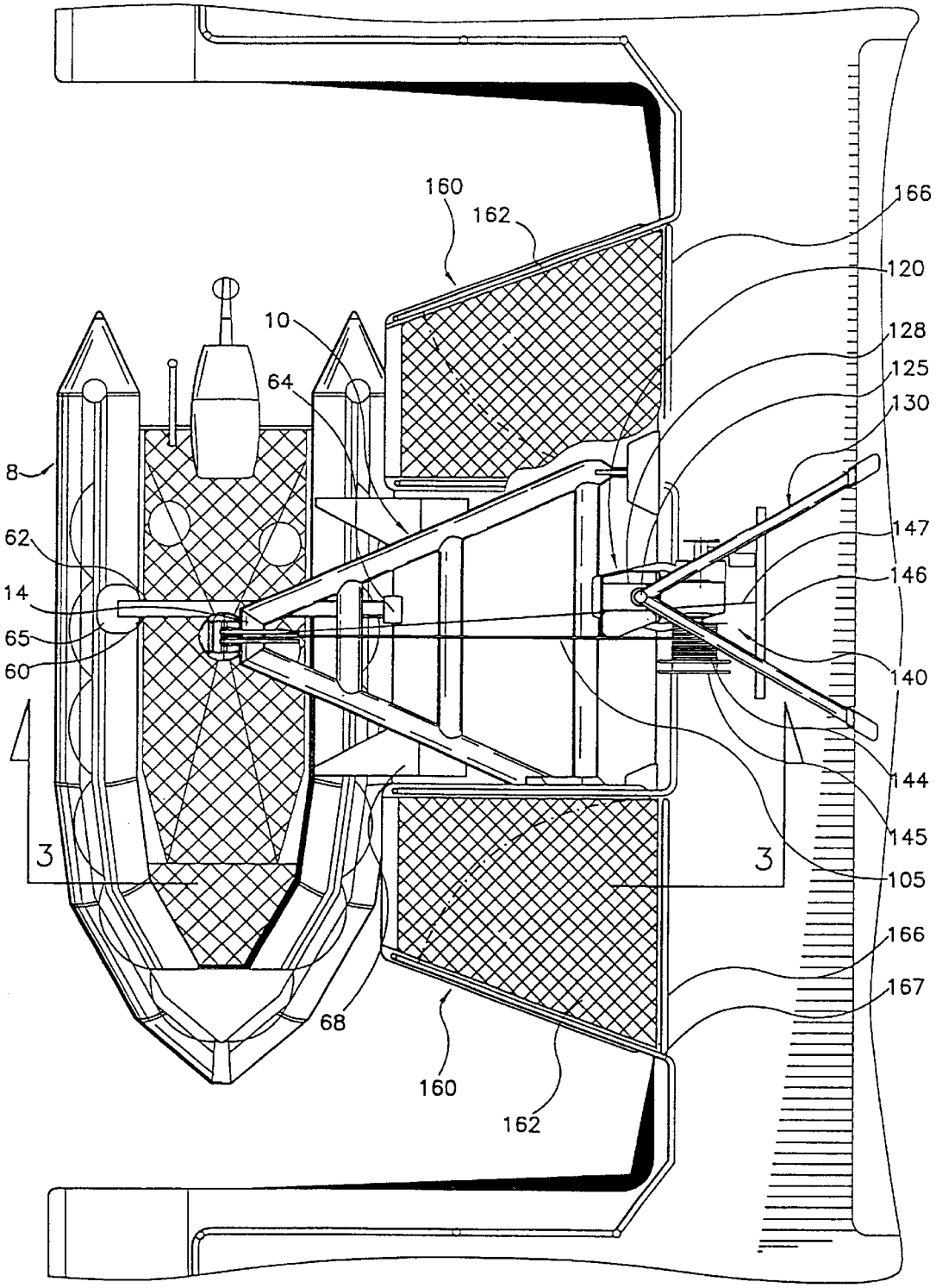
FIG. 2 is a top plan view of the boat davit of the present invention, with the rescue boat shown in stowage position.
Figure 3:
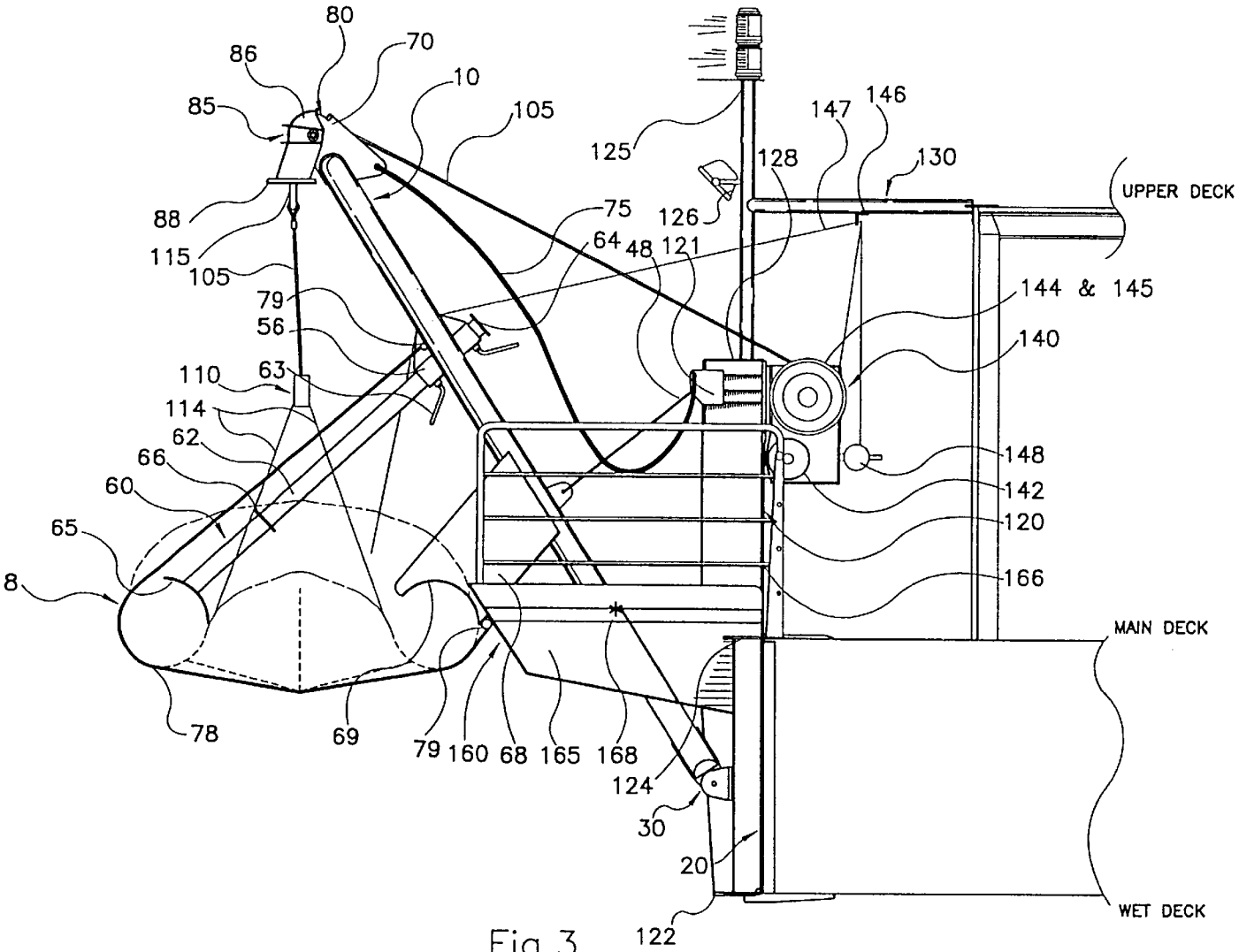
FIG. 3 is a cross-sectional view of the present invention taken along line 3—3 in FIG. 2.
Figure 4:
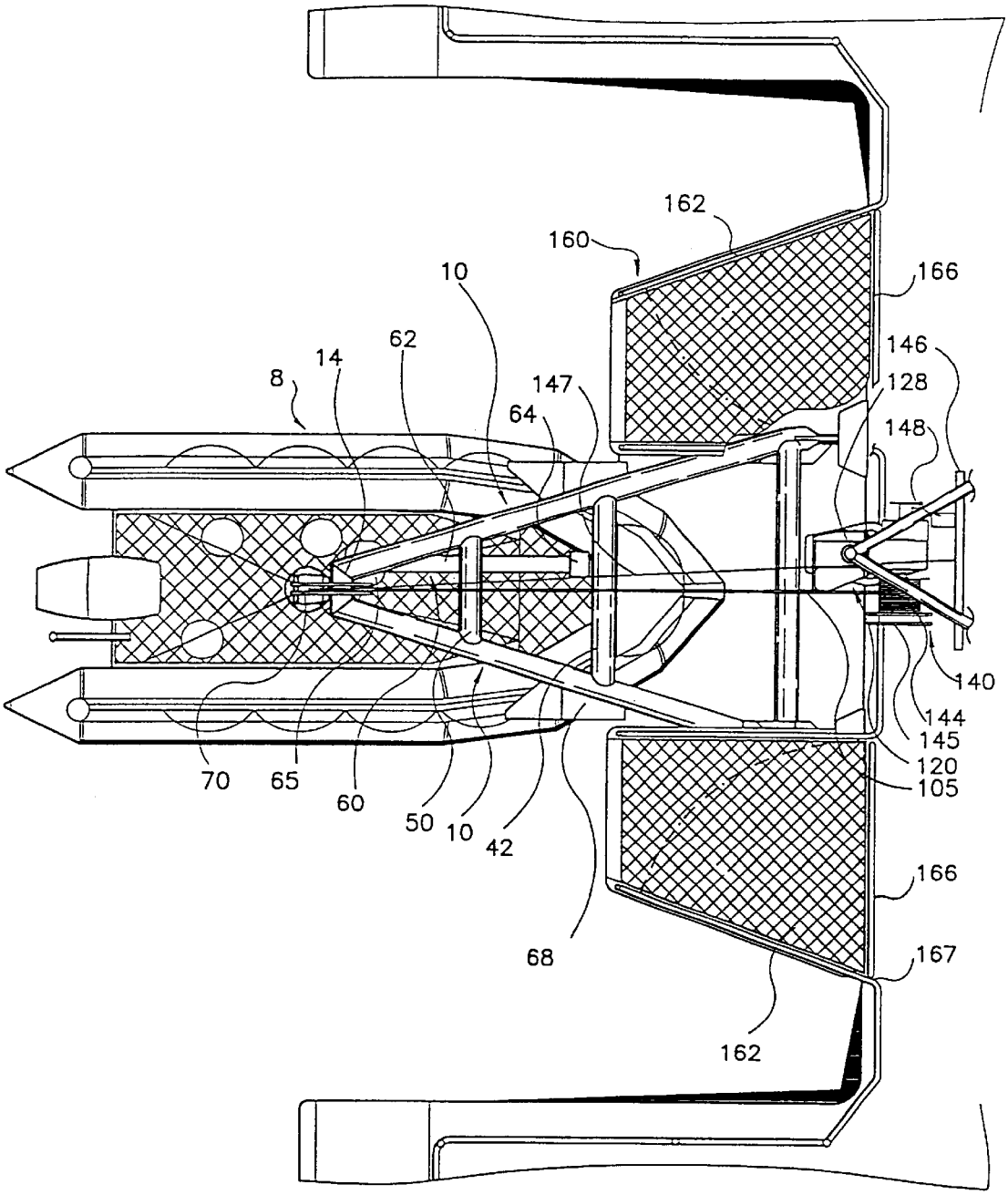
FIG. 4 is a top plan view of the present invention, with the rescue boat shown in deployed position.

As best illustrated in FIGS. 2, 3, and 5, the crutch assembly 60 comprises the support leg 62, having a square end plate 64 at one end thereof and a rubber-coated face 65 at the other end thereof. The face 65 is dimensioned to receive and support the rescue boat 8. A square midplate 66 is mounted on and welded to the support leg 62 near the face end of the support leg. The end plate 64 and midplate 66 are both dimensioned so that they are larger than the cross-sectional dimension of the support leg and can act as stops for the support leg to keep it positioned within the crutch-receiving tube 56. In addition, the end plate 64 is removably attached to the support leg 62, such as by bolts or the like, to allow the crutch assembly 60 to be removable.

The crutch assembly 60 is manually adjustable so that it can be positioned to provide support to the rescue boat when the boat is in a stowed position (see FIGS. 2 and 3). The crutch assembly is adjusted by rotating the clamp handles 63 until they no longer contact the supporting leg 62, then sliding the supporting leg 62, within the crutch-receiving tube, until the supporting leg and face plate 65 are in the desired boat-supporting position, then rotating the clamp handles in the opposite direction until they contact the supporting leg to hold it in the desired position.

Additional positioning and support for the rescue boat 8 is provided by brackets 68 which are mounted to the legs 12 of the A-frame. The brackets have a curved lower face 69 that is coated with rubber and dimensioned to contact and support the rescue boat when the rescue boat is in the stowed position. The rescue boat is secured to the A-frame by means of webbing straps 78 (FIG. 3) that are fastened to U-shaped web strap fittings 79 located on the cross bar 50 and on the boarding platform 160. As best illustrated in FIG. 3, the webbing straps 78 extend from the strap fittings 79 on the cross bar 50 around and under the rescue boat 8 to the strap fittings on the boarding platform. In addition to securing the rescue boat to the A-frame, the webbing straps serve to transfer the load of the rescue boat from the winch line 105 to the A-frame.

Figure 12:
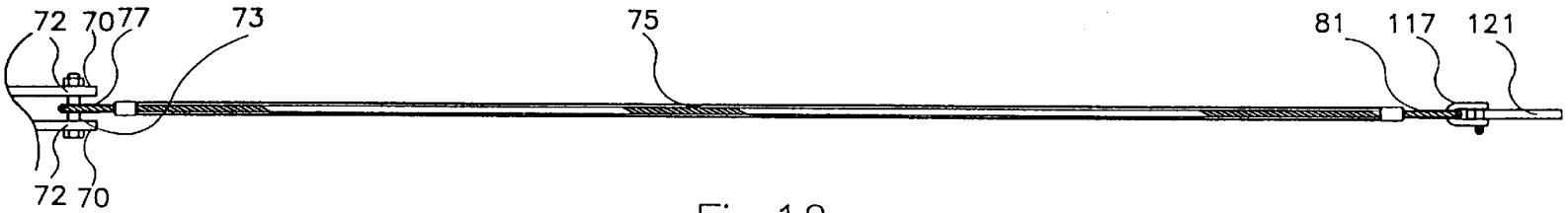
FIG. 12 is a side elevation view of the strop.

Referring back to FIGS. 6 and 7, mounted on the apex 14 of the A-frame lifting arm 10 is a matched pair of sheave cheek plates 70. The sheave cheek plates 70 each has a through hole 72 that receives a bolt 73 (see FIG. 12) for attaching one end of a wire strop 75 to the sheave cheek plates 70. As detailed more particularly in FIG. 12, the wire strop 75 has an eye or thimble 77 spliced into its end. The bolt 73 that connects the two cheek plates 70 also runs through the eye 77 of the wire strop 75 to connect the wire strop to the cheek plates 70. The other end of the wire strop has a similar eye 81 for receiving a "D" shackle 117 that fastens the strop 75 to the plate 121 mounted to the post assembly. Thus, as shown in FIGS. 3 and 5, the A-frame lifting arm 10 is connected to the post assembly 120 via the wire strop 75. Preferably, the wire strop is a ½ inch steel wire rope having a breaking load of 9,000 pounds. A suitable plastic sleeve typically surrounds the wire strop 75 and serves to protect the strop from chafing and the weather.

Figure 10:
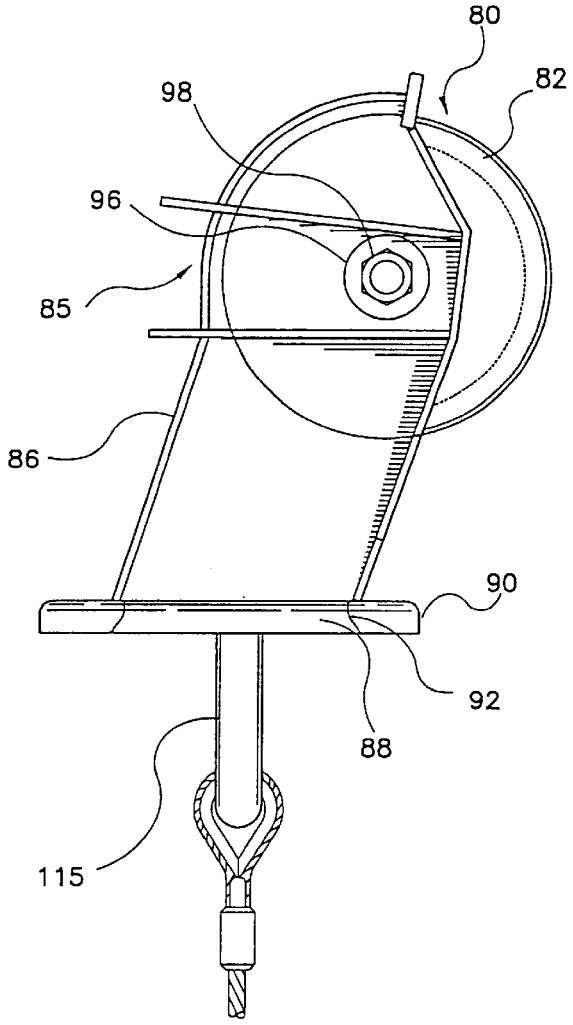
FIG. 10 is a cross-sectional side view of the davit stop fitting assembly.
Figure 9:
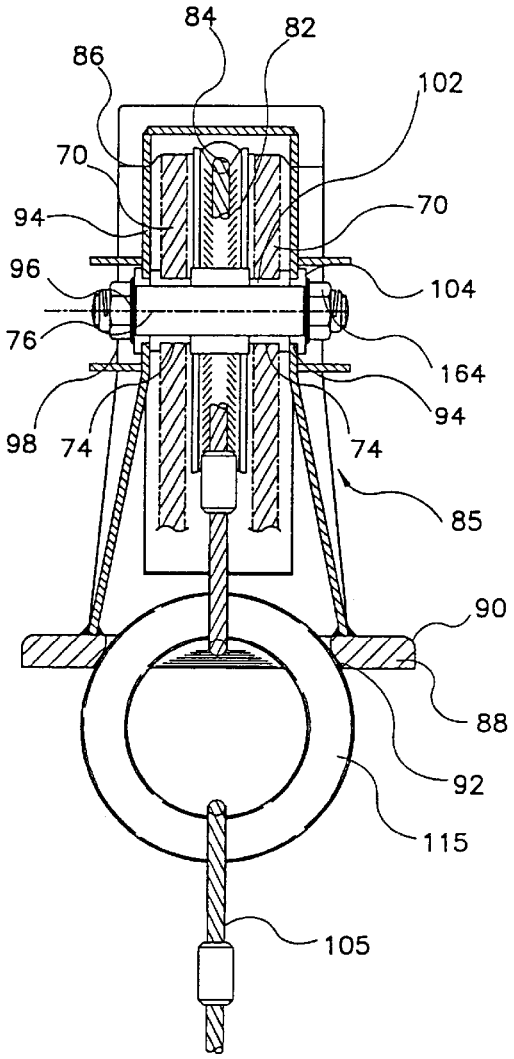
FIG. 9 is a cross-sectional front view of the davit stop fitting assembly.

The sheave cheek plates 70 each have a second through hole 74 (FIG. 7) which receives a sheave spindle 76 (FIG. 9) for mounting a sheave assembly 80 at the apex 14 of the A-frame lifting arm. As detailed more particularly in FIGS. 9 and 10, the sheave assembly 80 comprises a circular sheave 82 having a sealed roller bearing and a grooved circumferential surface 84. Sheave assemblies of the type suitable for use in the invention are available from several manufacturers, such as Washington Chain. The circular sheave 82 is positioned between the sheave cheek plates 70 and has an axial opening therethrough for receiving the sheave spindle 76.

Also mounted on the sheave spindle 76 is a davit stop fitting assembly 85. The davit stop fitting assembly is made of marine-grade stainless steel and comprises a housing 86 which surrounds the circular sheave 82, and a davit stop fitting plate 88 mounted to the base of the housing 86. The davit stop fitting plate is a ring-shaped plate having an outer diameter 90 that extends outwardly from the base of the housing and an inner diameter 92 which forms a mounting surface for the base of the housing 86. The housing 86 has opposed parallel side walls 94 which each have a through hole 95 for receiving the sheave spindle 76. The housing 86, the sheave cheek plates 70 and the sheave assembly 80 are all maintained on the sheave spindle 76 by means of a washer 96 and self locking nut 98 mounted on each end of the sheave spindle 76. Cheek plate bushes 102 and stop fitting bushes 104 are positioned within the through holes of the cheek plates 70 and the housing side walls 94, respectively, so as to ensure a close fit with the sheave spindle 76.

Figure 13A:
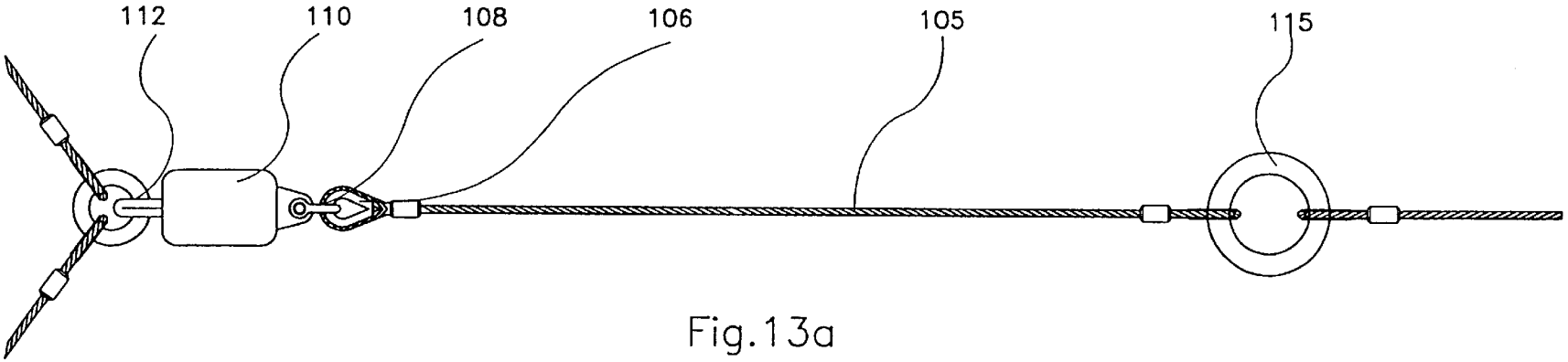
FIG. 13*a* is a top plan view of the winch line.
Figure 13B:
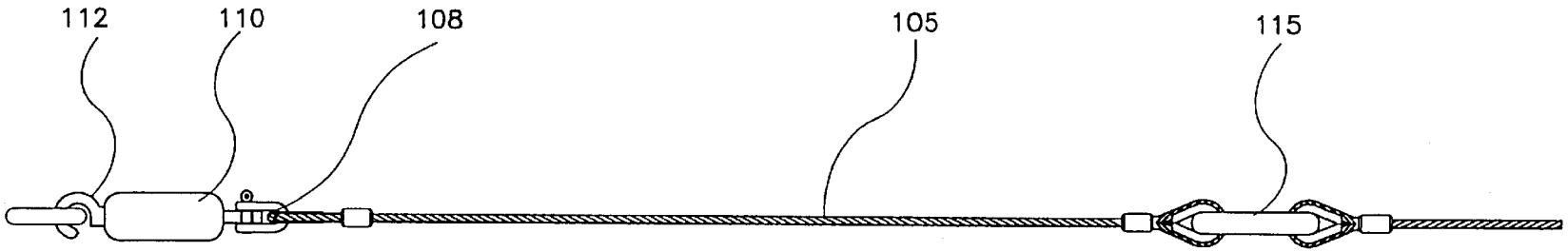
FIG. 13*b* is a side elevation view of the winch line.

The sheave assembly 80 accommodates a steel wire winch line 105 from the davit winch 140 (FIGS. 3 and 5). One end of the winch line 105 is securely clamped to and wound around a cable drum 144 of the davit winch 140. The winch line 105 extends from the electrical winch, over the sheave assembly 80 and down through the center opening of the stop fitting plate 88 to suspend the rescue boat 8 from the A-frame. As illustrated in FIGS. 13*a* and 13*b*, the other end of the winch line is fitted with a thimble 106 sized to receive a "D" shackle 108 which attaches a drop quick release device 110 to the end of the winch line 105. The drop quick release device 110 preferably has a hook 112 for releasably attaching the winch to strops 114 on the rescue boat 8. The hook 112 is an "on-load" release hook that enables the rescue boat to be released even if the winch line 105 is under tension. This is an advantageous feature since it is likely that, during deployment, the rescue boat will be released a few inches above the water surface, while the winch line is under tension, and the rescue boat will then drop into the water.

The winch line 105 also incorporates a steel ring 1 15 within its length. The outer diameter of the ring 115 is greater than the inner diameter 92 of the davit stop fitting plate 88 so that as the winch line is taken up, the steel ring 115 is taken up until it contacts and is stopped by the inner diameter of the davit stop fitting plate 88. Further winding of the winch line causes the A-frame 10 to pivot forward toward the ship. Thus, as explained in further detail below, the davit winch, along with the sheave assembly 80 and davit stop fitting assembly 85, provide the capability of hoisting and lowering the A-frame lifting arm 10 as well as the rescue boat 8. The positioning of the steel ring 115 on the winch line is relative to the drop quick release device 110 and is determined when the rescue boat is in its stowed position.

Figure 14:
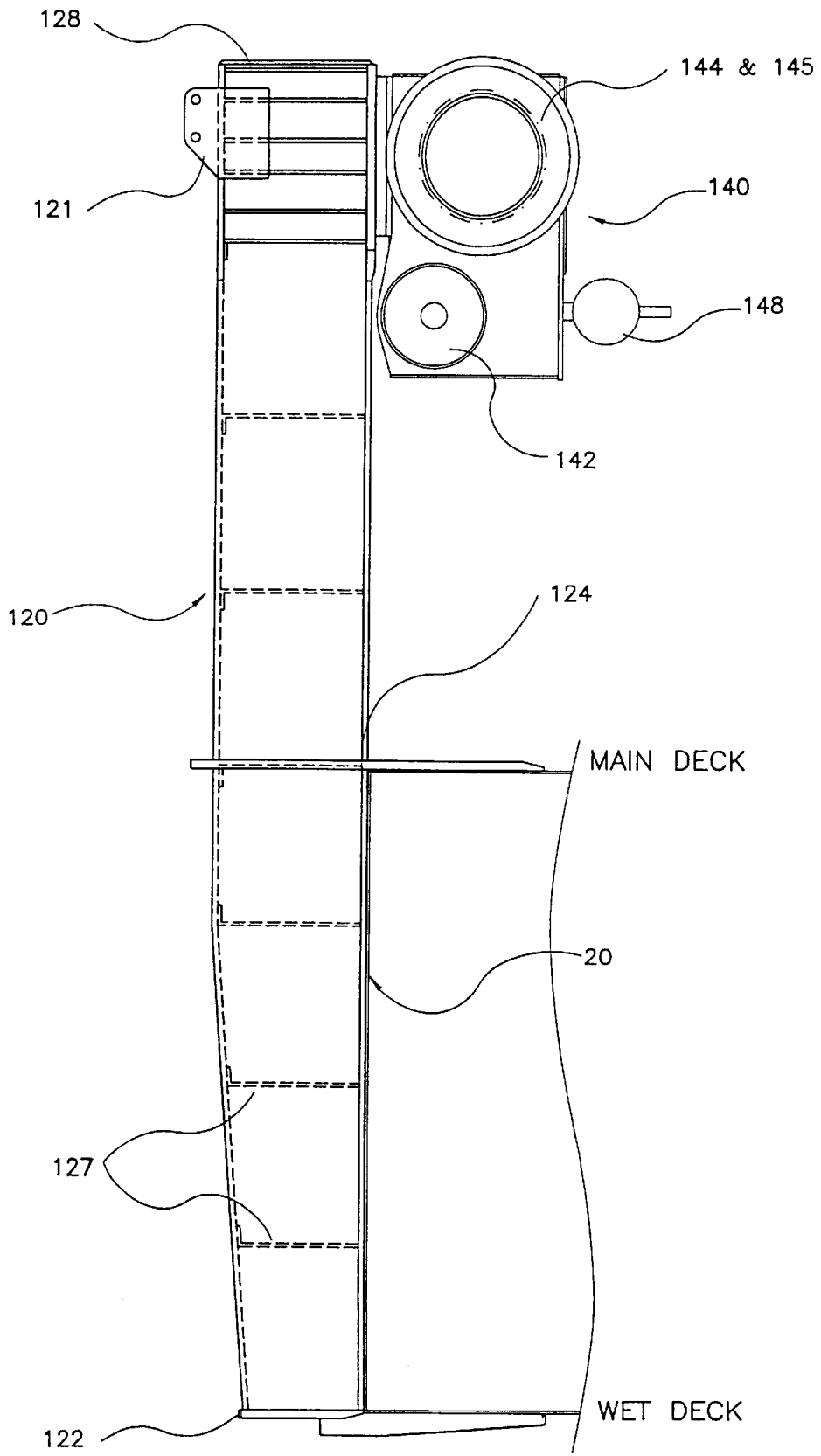
FIG. 14 is a side elevation view of the post assembly.
Figures 15, 16:
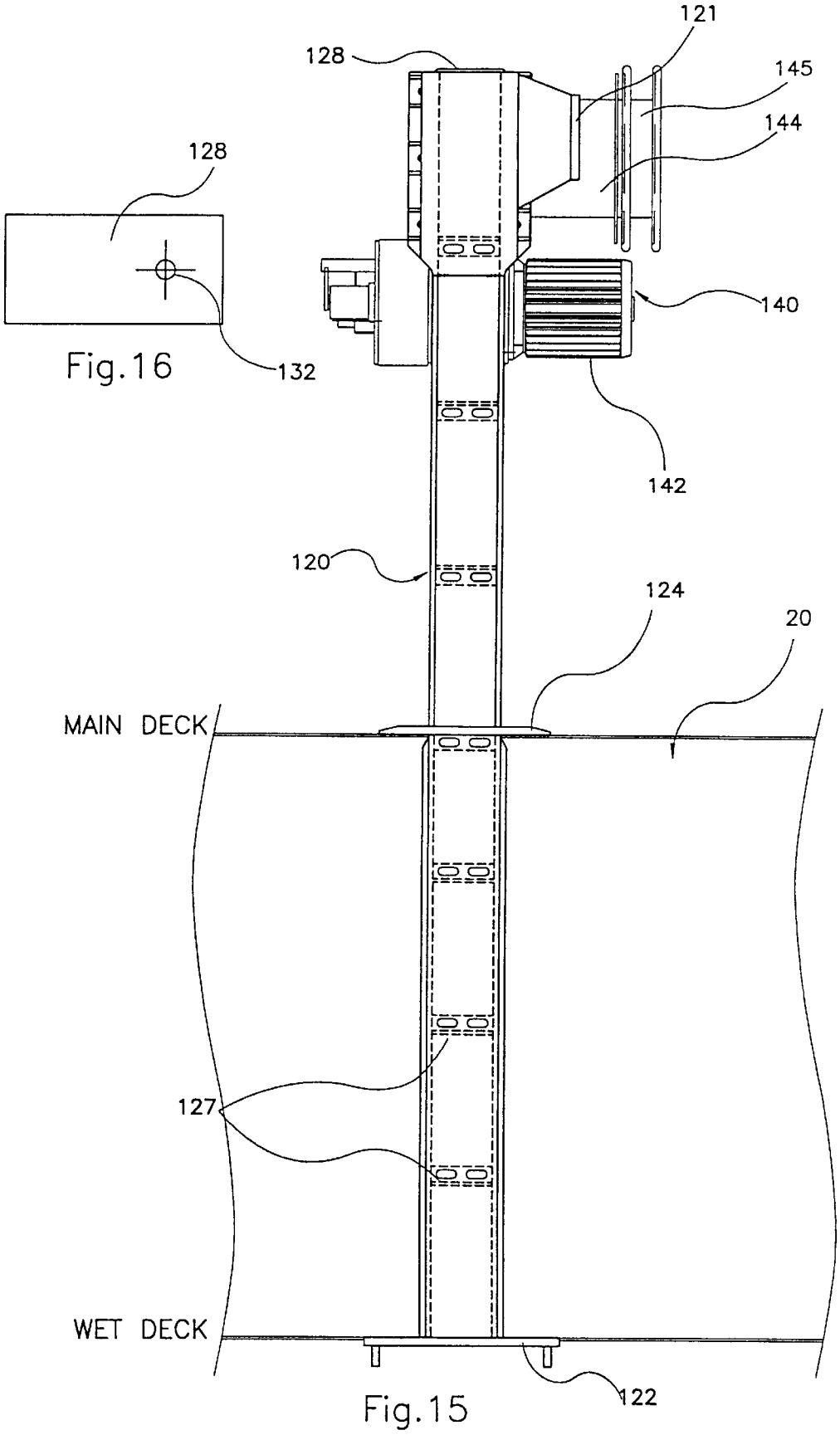
FIG. 15 is a front elevation view of the post assembly.
FIG. 16 is a top plan view of the top plate of the post assembly.

Referring now to FIGS. 14 and 15, the post assembly 120 is mounted to the transom 20 of the ship via tie plates 122 and 124 which are welded to the wet deck WD and main deck MD, respectively, of the ship. Preferably, the post assembly is constructed of aluminum, which will eliminate problems of corrosion between differing metals when the post assembly is mounted to an aluminum ship, such as the M/V CLOUD X. The post assembly is provided with horizontal stiffeners 127 and a top plate 128, each of which is provided with a drilled hole, such as the drilled hole 132 of top plate 128, illustrated in FIG. 16. The holes act as drains to minimize the amount of standing water in the post assembly and also allow electrical cable to run through the post assembly.

Referring to FIGS. 1–5, a navigation light pole 125, with an attached flood light 126 can be mounted to the top plate 128 of the post assembly. The flood light acts to illuminate the rescue boat at both deck level and launch level. Additional support for the navigation light pole can be provided by a V-shaped light support assembly 130 which has its apex welded to the light pole 125 and its ends attached to the upper deck planking.

The upper end of the post assembly 120 provides a mount for the davit winch 140. Although the davit winch could be mounted on another surface of a heavier ship, in the case of a lightweight ship, such as the MN CLOUD X, the post assembly advantageously provides favorable stress and load characteristics. In addition, the post assembly provides other attractive features and advantages for the MN CLOUD X. For example, the post assembly allows more working space between the winch and the deckhouse of the ship. It also provides a mount for a battery charger for recharging the rescue boat batteries, and it provides the foundation for the navigation lights which are required to be located far aft and on the centerline of the ship. Finally, use of the post assembly makes the entire davit "retrofittable" onto a fully built, weight sensitive aluminum ship.

The davit winch 140 is preferably an electrical winch that includes an electrical motor 142 which drives the cable drum 144 onto which one end of the winch line 105 is clamped and wound. A satisfactory winch for use herein is a single-drum, gravity-lowering electrical hoisting geared device with a safe working moment of 3.3kNm. One suitable device is available from Schat-Harding in the Netherlands, model number FME 3.3 SPM (v). This device has been approved by the USCG as meeting SOLAS requirements, approval number 160.115/56/0.

Also available from the same manufacturer is a remote-release mechanism that provides for remote release of the winch brake from within the rescue boat itself. Remote release of the winch brake enables launch from within the rescue boat itself and also enables the boat davit to launch the rescue boat using gravity alone, without requiring use of the ship's electrical power. The remote release mechanism includes a release line 147 which has one end attached to a secondary drum 145 mounted on the end of the cable drum 144. A suitable material for the release line is ½-inch braided nylon line. The release line runs from the secondary drum 145 through a series of pulleys 150*a*–150*d* over cross bar 50 and down into the rescue boat 8.

Figure 17:
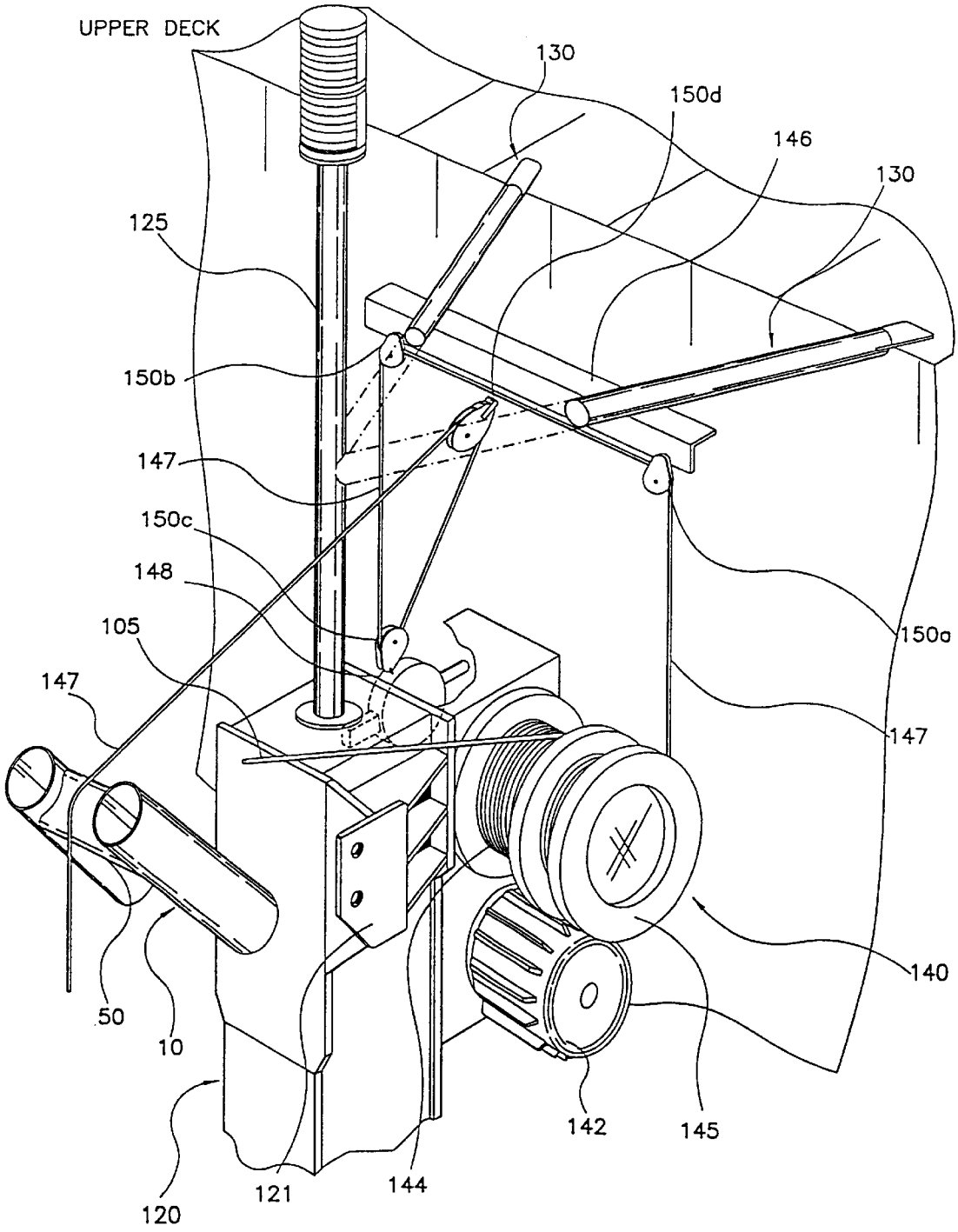
FIG. 17 is a perspective view of the remote release mechanism.

As shown in further detail in FIG. 17, pulleys 150*a*, 150*b* and 150*d* are mounted on an aluminum angle bar 146 which is welded to the underside of the light support assembly 130. Pulley 150*a* is located roughly within the same vertical plane as the secondary drum 145, pulley 150*b* is roughly within the same vertical plane as the winch hand brake 148, and pulley 150*d* is approximately aligned with the cross bar 50. The pulley 150*c* is located on the winch hand brake 148. The release line 147 runs through pulleys 150*a* and 150*b* on the angle bar 146, down through pulley 150*c* on the winch hand brake 148, up to the pulley 150*d* on the angle bar 146, and then over the cross bar 50 and down to the rescue boat. Pulling on the release line causes the release line to release the winch brake, which frees the winch line to operate by gravity alone.

Referring back to FIGS. 1–5, a boarding platform 160 is mounted to the ship to allow boarding of the rescue boat 8 from the main deck MD when the rescue boat is in its stowed position. The boarding platform includes a pair of tread plates 162 which are welded to and extend from the main deck of the ship. The tread plates 162 are each supported by an inner web assembly 163 and an outer web assembly 165 which are welded to the transom of the ship. Each inner web assembly 163 includes an A-frame housing or rest plate 164. The A-frame 10 comes in contact with the plates 164 when the A-frame is in its stowed position. The plates 164 are covered with a rubber surface to provide cushioning when in contact with the A-frame. Capacitive proximity sensors 168, which automatically cut out the electric winch motor when the A-frame 10 nears the housing plates 164, are mounted on each side of the boarding platform in the vicinity of the asterisk shown in FIG. 3. One suitable sensor for use in the present invention is model 875 CP AC, cable style threaded barrel, available from Rockwell Automation/Allen-Bradley, Chelmsford, Massachusetts.

Access to the tread plates 162 is provided via hinged gates 166. The gates are hinged at hinge line 167 and swing open over the tread plates 162 to form railings on the outboard edges of the tread plates 162. When the hinged gates 166 are open, they are pinned in place by inserting an aluminum pin (not shown) at their bottom through a hole drilled in the tread plate 162. The hinged gates 166 are shown in a closed position in FIG. 1 and in an open, pinned position in FIG. 3.

In operation, the davit is designed for the following two positions: the stowage position and the deployed position. In the stowage position, as illustrated in FIGS. 2 and 3, the wire strop 75 is slack, the A-frame 10 is hard against the housing plate 164, and the rescue boat 8 is hard against the bracket 68 and the crutch assembly 60. The A-frame 10 is maintained in the stowage position by the securing wire 48 connected between the A-frame 10 and the post assembly 120. In this position, the rescue boat 8 can be secured to the A-frame by the use of the webbing straps 78. The securing wire 48 and the webbing straps 78 both serve to take the load off the winch 140 and the winch line 105. When in the stowage position, the rescue boat is oriented athwartships.

In deploying the rescue boat, with the ship at 0–5 knots forward speed, typically, two crew members prepare the rescue boat for launch by unhooking the securing wire 48 and webbing straps 78 and boarding the rescue boat via the boarding platform 160. The crutch assembly 60 is then raised so that it no longer contacts the rescue boat, and both the A-frame 10 and the rescue boat 8 are supported by the winch via the winch line 105. As the winch is operated, the A-frame rotates aft approximately 20° until the retaining wire strop 75 is taut, as illustrated in FIG. 5. The A-frame swings the rescue boat far enough aft so that there is sufficient space to rotate the rescue boat to a fore and aft orientation. Continued operation of the winch lowers the rescue boat. As the rescue boat is lowered, it is rotated from an athwartships orientation to a fore and aft one by means of two painters tied to the ship so that, as it approaches the water, it will be pointed in the same direction as the ship. When the rescue boat is near the water, one of the crewmen aboard the rescue boat releases the on-load release hook that connects the winch line to the rescue boat strops, and the rescue boat is then free from the winch line and the ship.

Recovery of the rescue boat employs the same procedure but in reverse. With the ship at zero forward speed, a crewman in the rescue boat attaches the release hook at the end of the winch line to the rescue boat. As the boat is raised, using the winch, it is raised to the point where the steel ring 115 on the winch line fits into the davit stop fitting plate 88. The rescue boat is then rotated to an athwartships orientation by use of the two painters and secured to the A-frame by the webbing straps 78. Continued hoisting by the winch then rotates the A-frame approximately 20° forward. The capacitive proximity sensors 168 are used to cut out the winch motor when the A-frame gets to within a few inches of its final stowage position. After the winch motor is cut out, the A-frame and the rescue boat are brought home to their stowage positions by using a hand crank located on the electric winch.

From the foregoing description and drawings, it can be seen that the boat davit of the present invention complies with all the SOLAS requirements and is USCG approved. The rescue boat is stowed in a state of readiness and access to the boat via the boarding platform allows rapid boarding. The remote release device allows the davit to be operable by a person within the rescue boat and further allows the davit to be operable independent of the ship's power. As illustrated in phantom in FIG. 5, the davit is capable of launching the rescue boat in the 10° bow down trim condition. Finally, the A-frame, the post assembly and the winch operate together to provide acceptable lowering and hoisting speeds and appropriate factors of safety. Although the boat davit has been designed to permit emergency evacuation of a ship, it will be appreciated that the boat davit of the present invention is also used in other emergency situations, such as "man overboard" or oil spill scenarios.

Numerous modifications may be made to the foregoing device without departing from the basic teachings thereof.

Although the present invention has been described in substantial detail with reference to one or more specific embodiments, those of skill in the art will recognize that changes may be made thereto without departing from the scope and spirit of the invention as set forth in the appended claims.

What is claimed is:

1. A rescue boat davit for stowing, launching and retrieving a rescue boat for a ship comprising:

(a) an A-shaped frame comprising two elongated legs integrally joined at one end thereof to form an apex, and pivotally mounted at the other end thereof to the ship, the A-shaped frame being pivotally moveable between an upright rescue boat stowage position and a lowered rescue boat launching and retrieving position, the A-shaped frame further having a sheave assembly mounted on the apex;

(b) a winch assembly comprising a cable drum and a winch line, one end of the winch line being securely clamped to and wound on the cable drum and the other end being releasably fastened to the rescue boat, the winch line passing over the sheave assembly to suspend the rescue boat from the apex of the A-shaped frame, and (c) an upright post mounted to the ship, the upright post providing a mount for the winch assembly.

2. A rescue boat davit according to claim 1 wherein the A-shaped frame includes a crutch assembly for supporting the rescue boat when the rescue boat is stowed.

3. A rescue boat davit according to claim 2 wherein the crutch assembly is manually adjustable relative to the rescue boat.

4. A rescue boat davit according to claim 2 wherein the crutch assembly comprises a support leg releasably clamped to the A-shaped frame and a face plate mounted on one end of the support leg, the face plate being dimensioned to receive and support the rescue boat.

5. A rescue boat davit according to claim 1 wherein the sheave assembly comprises a circular sheave mounted on a spindle, the circular sheave having a circumferentially grooved outer surface to receive and maintain the winch line around the circular sheave.

6. A rescue boat davit according to claim 1 further including a wire strop having one end connected to the A-shaped frame and another end connected to the upright post.

7. A rescue boat davit according to claim 1 wherein the A-shaped frame includes a davit stop fitting assembly mounted over the sheave assembly.

8. A rescue boat davit according to claim 7 wherein the davit stop fitting assembly comprises a housing having a base and a stop plate mounted to the base, the stop plate having an outer diameter that extends outwardly from the base of the housing, and an inner diameter that forms a mounting surface for the base of the housing.

9. A rescue boat davit according to claim 8 wherein the housing and the sheave assembly are mounted on a spindle.

10. A rescue boat davit according to claim 8 wherein the winch line incorporates a metal ring within its length, the metal ring having an outer diameter that is greater than the inner diameter of the stop plate whereby, as the winch line is taken up on the cable drum, the metal ring contacts and cooperates with the stop plate, and further winding of the winch line causes the A-shaped frame to pivot forward to its upright stowage position.

11. A rescue boat davit according to claim 1 further including a boarding platform mounted to the ship, the boarding platform permitting loading of the rescue boat when the rescue boat is stowed.

12. A rescue boat davit for storing, launching and retrieving a rescue boat for a ship comprising:

an A-shaped frame comprising two elongated legs having inboard and outboard ends, the outboard ends being joined to form an apex, and the inboard ends being pivotally mounted to the ship, the A-shaped frame being pivotally moveable between an upright rescue boat stowage position and a lowered rescue boat launching and retrieving position, the A-shaped frame further having a sheave assembly mounted on the apex;

a winch assembly comprising a cable drum and a winch line, the winch line having one end thereof securely clamped to and wound on the cable drum and the other end thereof releasably fastened to the rescue boat, the winch line passing over the sheave assembly to suspend the rescue boat from the apex of the A-shaped frame; and an upright post assembly having a base mounted to the ship and an upper end providing a mount for the winch assembly.

13. A rescue boat davit according to claim 12 wherein the A-shaped frame includes a crutch assembly for supporting the rescue boat when the rescue boat is stowed.

14. A rescue boat davit according to claim 13 wherein the crutch assembly comprises a support leg releasably clamped to the A-shaped frame and a face plate mounted on one end of the support leg, the face plate being dimensioned to receive and support the rescue boat.

15. A rescue boat davit according to claim 12 wherein the A-shaped frame includes a davit stop fitting assembly mounted over the sheave assembly.

16. A rescue boat davit according to claim 15 wherein the davit stop fitting assembly comprises a housing having a base and a stop plate mounted to the base, the stop plate having an outer diameter that extends outwardly from the base of the housing, and an inner diameter that forms a mounting surface for the base of the housing.

17. A rescue boat davit according to claim 16 wherein the housing and the sheave assembly are mounted on a spindle.

18. A rescue boat davit according to claim 17 wherein the winch line incorporates a metal ring within its length, the metal ring having an outer diameter that is greater than the inner diameter of the stop plate, whereby, as the winch line is taken up on the cable drum, the metal ring contacts and cooperates with the stop plate, and further winding of the winch line causes the A-shaped frame to pivot forward to its upright stowage position.

* * * * *